US010194236B2

(12) United States Patent
Niidera et al.

(10) Patent No.: US 10,194,236 B2
(45) Date of Patent: Jan. 29, 2019

(54) SPEAKER FRAME AND SPEAKER HAVING THE SAME

(71) Applicants: Pioneer Corporation, Kawasaki-shi, Kanagawa (JP); Tohoku Pioneer Corporation, Tendo-shi, Yamagata (JP)

(72) Inventors: Shintaro Niidera, Tendo (JP); Satoshi Hachiya, Tendo (JP)

(73) Assignees: PIONEER CORPORATION, Tokyo (JP); TOHOKU PIONEER CORPORATION, Yamagata (JP)

( * ) Notice: Subject to any disclaimer, the term of this patent is extended or adjusted under 35 U.S.C. 154(b) by 0 days.

(21) Appl. No.: 15/913,796

(22) Filed: Mar. 6, 2018

(65) Prior Publication Data

US 2018/0199133 A1 Jul. 12, 2018

Related U.S. Application Data

(63) Continuation of application No. 15/722,467, filed on Oct. 2, 2017, now Pat. No. 10,015,585, which is a (Continued)

(51) Int. Cl.
*H04R 9/06* (2006.01)
*H04R 1/28* (2006.01)

(Continued)

(52) U.S. Cl.
CPC ..... *H04R 1/2873* (2013.01); *H04R 1/02* (2013.01); *H04R 1/025* (2013.01); *H04R 7/18* (2013.01);

(Continued)

(58) Field of Classification Search
CPC ..... H04R 1/02; H04R 1/2873; H04R 7/18; H04R 9/025; H04R 9/045; H04R 9/06; H04R 31/006; H04R 2209/027; H04R 2400/11; H04R 2499/13

(Continued)

(56) References Cited

U.S. PATENT DOCUMENTS 4,590,332 A 5/1986 Delbuck
5,447,485 A 9/1995 Bory et al.

(Continued)

FOREIGN PATENT DOCUMENTS

JP 51-072122 6/1976
JP 52-120838 10/1977

(Continued)

OTHER PUBLICATIONS

Office Action for JP App No. 2010-505117 dated Dec. 6, 2011.

*Primary Examiner* — Huyen D Le
(74) *Attorney, Agent, or Firm* — Procopio, Cory, Hargreaves & Savitch LLP

(57) ABSTRACT

A speaker frame, including: a vibration support portion supporting a vibrating body of a speaker; a magnet support portion arranged inside of said vibration support portion and supporting magnetic circuit portion of said speaker; and a plurality of connection beams connecting said vibration support portion and said magnet support portion, wherein the vibration support portion and the magnet support portion have a circular ring shape having the same major axis length and minor axis length, said plurality of connection beams are arranged radially centering on a central axis from said magnet support portion to said vibration support portion, the central axis being parallel to a direction of an acoustic radiation, and a length of one of said connection beams and a length of another connection beams are different from each other.

21 Claims, 13 Drawing Sheets

Related U.S. Application Data continuation of application No. 15/425,312, filed on Feb. 6, 2017, now Pat. No. 9,924,262, which is a continuation of application No. 15/137,993, filed on Apr. 25, 2016, now Pat. No. 9,602,900, which is a continuation of application No. 14/834,875, filed on Aug. 25, 2015, now Pat. No. 9,351,058, which is a continuation of application No. 14/247,684, filed on Apr. 8, 2014, now Pat. No. 9,148,715, which is a continuation of application No. 12/933,321, filed as application No. PCT/JP2008/056085 on Mar. 28, 2008, now Pat. No. 8,731,232.

(51) Int. Cl.

| | |
|---|---|
| ***H04R 9/02*** | (2006.01) |
| ***H04R 9/04*** | (2006.01) |
| ***H04R 7/18*** | (2006.01) |
| ***H04R 1/02*** | (2006.01) |
| ***H04R 31/00*** | (2006.01) |

(52) U.S. Cl.

CPC ..... *H04R 9/025* (2013.01); *H04R 9/045* (2013.01); *H04R 9/06* (2013.01); *H04R 31/006* (2013.01); *H04R 2209/027* (2013.01); *H04R 2400/07* (2013.01); *H04R 2400/11* (2013.01); *H04R 2499/13* (2013.01)

(58) Field of Classification Search

USPC ..... 381/86, 302, 332, 386, 389, 189, 396, 381/398, 412, 420, 432, 433; 181/171, 181/172, 199

See application file for complete search history.

(56) References Cited

U.S. PATENT DOCUMENTS

| | | | | |
|---|---|---|---|---|
| 6,731,773 | B1 | 5/2004 | Bergbower et al. | |
| 7,184,568 | B2 | 2/2007 | Chan | |
| 7,357,218 | B2 | 4/2008 | Sasaki | |
| 7,570,774 | B2 | 8/2009 | Jeong et al. | |
| 7,668,333 | B2 | 2/2010 | Horigome et al. | |
| 7,916,890 | B2 * | 3/2011 | Irby ..... | H04R 7/122 381/396 |
| 8,731,232 | B2 | 5/2014 | Niidera et al. | |
| 9,148,715 | B2 | 9/2015 | Niidera et al. | |
| 9,351,058 | B2 | 5/2016 | Niidera et al. | |
| 9,479,873 | B2 | 10/2016 | Yamagami et al. | |
| 9,602,900 | B2 | 3/2017 | Niidera et al. | |
| 2003/0194104 | A1 | 10/2003 | Irby et al. | |
| 2004/0197007 | A1 * | 10/2004 | Onuma ..... | H04R 9/02 381/423 |
| 2006/0147066 | A1 | 7/2006 | Horigome et al. | |
| 2006/0237258 | A1 | 10/2006 | Sasaki | |
| 2007/0003101 | A1 | 1/2007 | Yang | |
| 2008/0049965 | A1 | 2/2008 | Iwata | |
| 2009/0175486 | A1 | 7/2009 | Suzuki | |

FOREIGN PATENT DOCUMENTS

| | | |
|---|---|---|
| JP | 56-163389 | 12/1981 |
| JP | 62-077995 | 4/1987 |
| JP | 03-035696 | 2/1991 |
| JP | 04-031540 | 2/1992 |
| JP | 11-341574 | 12/1999 |

* cited by examiner

FIG. 8A
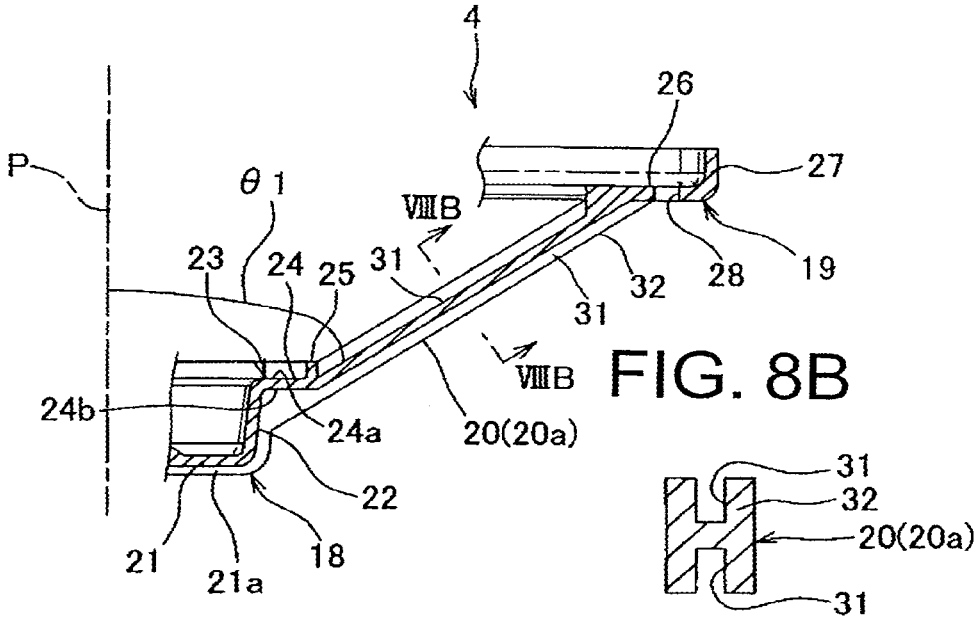
FIG. 8B
FIG. 9
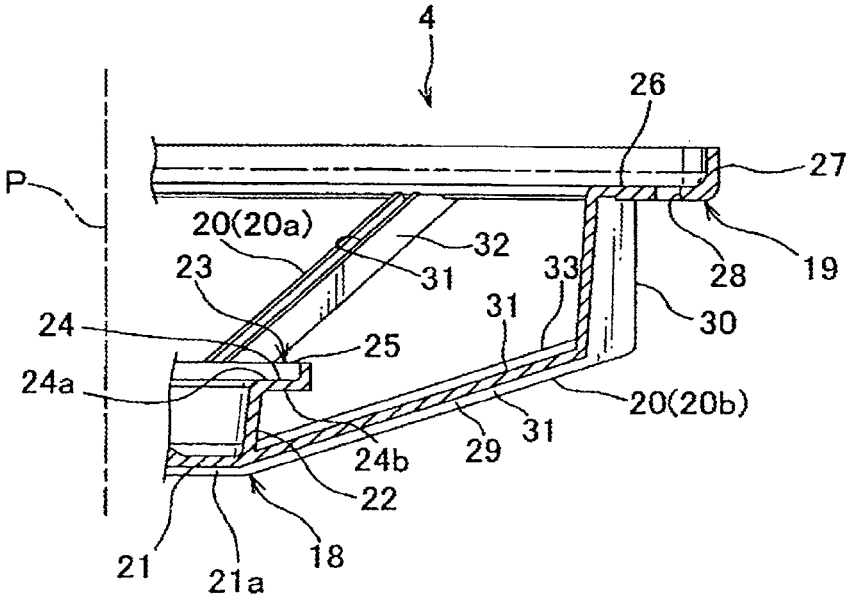

SPEAKER FRAME AND SPEAKER HAVING THE SAME

CROSS REFERENCE TO RELATED APPLICATIONS

This application is a Continuation Application of U.S. application Ser. No. 15/722,467 filed Oct. 2, 2017, which is a Continuation Application of U.S. application Ser. No. 15/425,312 filed Feb. 6, 2017, which is a Continuation Application of U.S. application Ser. No. 15/137,993 filed Apr. 25, 2016, now U.S. Pat. No. 9,602,900, issued Mar. 21, 2017, which is a Continuation application of Ser. No. 14/834,875 filed Aug. 25, 2015, now U.S. Pat. No. 9,351,058, issued May 24, 2016, which is a Continuation of U.S. application Ser. No. 14/247,684 filed Apr. 8, 2014, now U.S. Pat. No. 9,148,715, issued Sep. 29, 2015, which is a Continuation of U.S. application Ser. No. 12/933,321 filed Sep. 17, 2010, now U.S. Pat. No. 8,731,232, issued May 20, 2014, which is a National Stage of International Application No. PCT/JP2008/056085, filed Mar. 28, 2008, the content of which is incorporated herein by reference in its entirety.

FIELD OF THE INVENTION

The present invention relates to a speaker frame and a speaker having the same, the speaker generates sound by causing a diaphragm to vibrate by supplying voice currents.

DESCRIPTION OF THE RELATED ART

Various speakers (refer for example to Patent Literature 1) are mounted to a motor vehicle as a moving body. The speaker includes: a speaker frame 100 (shown in FIG. 1 and FIG. 2, hereinafter called the frame, refer for example to Patent Literature 1); a vibrating portion placed at an inner side of the frame 100; and a magnetic circuit portion mounted to the frame 100 and causing a diaphragm of the vibrating portion to vibrate.

As shown in FIG. 1 and FIG. 2, the frame 100 according to the above-described Patent Literature 1 includes: a circular-ring-like magnet support portion 101; a circular-ring-like vibration support portion 102 having an inner diameter larger than an outer diameter of the magnet support portion 101; a plurality of connection beams 103 connecting the magnet support portion 101 and the vibration support portion 102. The magnetic circuit portion is arranged on a surface of and is attached to the magnet support portion 101. An edge connected with a diaphragm of the vibration support portion is attached to an inner edge of the vibration support portion 102. The magnet support portion 101 and the vibration support portion 102 are arranged concentrically with each other.

The connection beams 103 are formed into a linear rod-like shape, and one end thereof is connected to the magnet support portion 101 while the other end thereof is connected to the vibration support portion 102. A longitudinal direction of the respective connection beams 103 is arranged in parallel with a radial direction of the magnet support portion 101 and the vibration support portion 102. The connection beams 103 are arranged at an equal interval along a circumferential direction of the magnet support portion 101 and the vibration support portion 102. Furthermore, in a cross section passing through a central axis P1 of the speaker (indicated by a dotted line shown in FIG. 1 and FIG. 2), the plurality of connection beams 103 are formed such that an angle between the connection beam 103 and the central axis P1 are equal.

For the speaker including the above-described structure, voice currents are supplied to a voice coil attached to the diaphragm to allow the diaphragm to vibrate along the central axis P1 by an electromagnetic force (Lorentz force) exerted on the voice coil. Thus, the speaker generates sound corresponding to the voice currents in a direction of an acoustic radiation.

[Patent Literature 1] Japanese Patent Application Publication No. H07-95687

SUMMARY OF THE INVENTION

Technical Problem

For the frame 100 shown in the above-described Patent Literature 1, the plurality of connection beams 103 are arranged so that in the cross-section passing through the central axis P1, inclination angles to the central axis P1 of the speaker for a longitudinal direction of the connection beams 103 are equal with each other. Therefore, the speaker has a problem that, when mounting the speaker to a door panel of a motor vehicle, the frame 100, specially the plurality of connection beams 103 is distorted, e.g. curved, distortion being produced in the entire frame 100. Furthermore, the distortion of the edge is produced with the distortion of the frame 100, causing a position of the voice coil in the magnetic circuit portion, particularly in a magnetic gap, to be displaced from a desirable position. The displacement of the voice coil may cause several problems such that the voice coil contacts with a plate of the magnetic circuit portion, and an acoustic characteristic is reduced by generation of an unwanted noise.

Furthermore, for the above-described speaker, there is a problem such that the door vibrates by vibrations of the moving vehicle and the frame 100 is distorted by the vibrations as above and the frame easily resonates with the door. There are some problems that the resonance may cause the vibration of the magnetic circuit portion, a voice coil contacting with the plate of the magnetic circuit portion, an unwanted vibration transmitting to the diaphragm, and the acoustic characteristic reducing easily by an unwanted vibration transmitting to the diaphragm.

In addition, when the speaker is driven, the magnetic circuit portion vibrates. There is a problem that the vibration of the magnetic circuit induces a resonance in the frame. There are some problems such as an unwanted vibration transmitting to the diaphragm of a vibrating body due to the resonance, and the acoustic characteristic reducing easily by the unwanted vibration transmitting to the diaphragm.

The present invention is intended to address these problems. Therefore, an object of the present invention is to provide a speaker frame which is prevented from being distorted, e.g. curved, as well as to provide a speaker having this speaker frame.

Solution to Problem

In order to solve the above-described problems and achieve the above-described object, a speaker frame on the present invention according to claim 1 includes: a vibration support portion supporting a vibrating body of a speaker; a magnet support portion arranged inside of the vibration support portion and supporting a magnetic circuit portion of the speaker; and a plurality of connection beams connecting the vibration support portion and the magnet support portion, in which, in a cross-section passing through a central axis of the speaker, an inclination angle of one connection beam of the connection beams to the central axis and to an inclination angle of other connection beam to the central axis are different from each other.

BRIEF DESCRIPTION OF THE DRAWINGS

FIG. 8A is a cross-sectional view taken along a line VIIIA-VIIIA shown in FIG. 4, and FIG. 8B is a cross-sectional view taken along a line VIIIB-VIIIB shown in FIG. 8A;

FIG. 9 is a cross-sectional view of a modified example of the frame shown in FIG. 7.

REFERENCE SIGNS LIST

Figure 1:
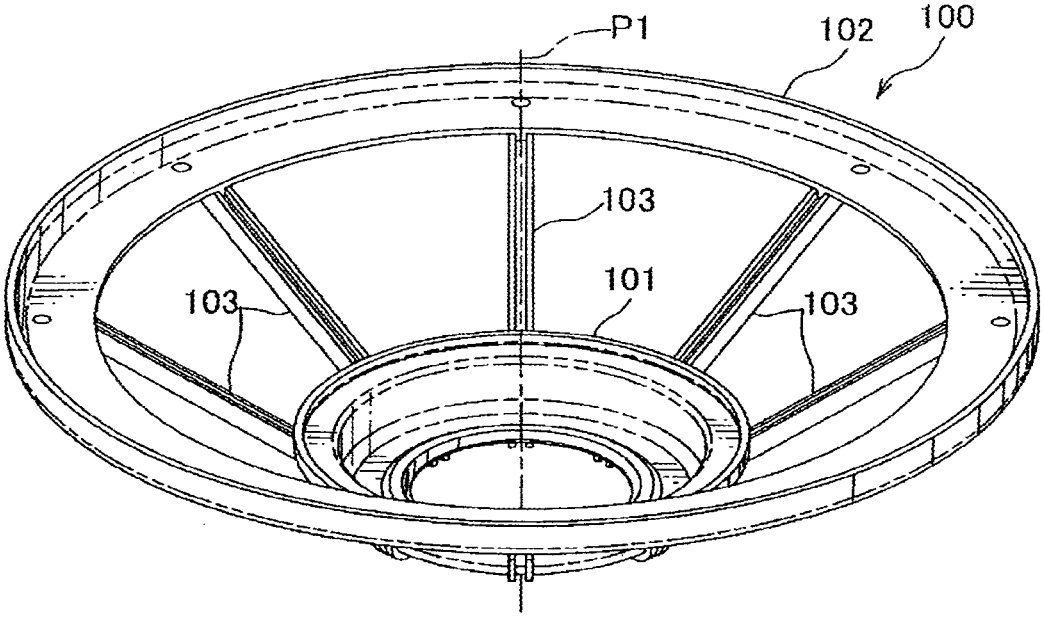
FIG. 1 PRIOR ART
FIG. 1 is a perspective view of a conventional speaker frame.
Figure 2:
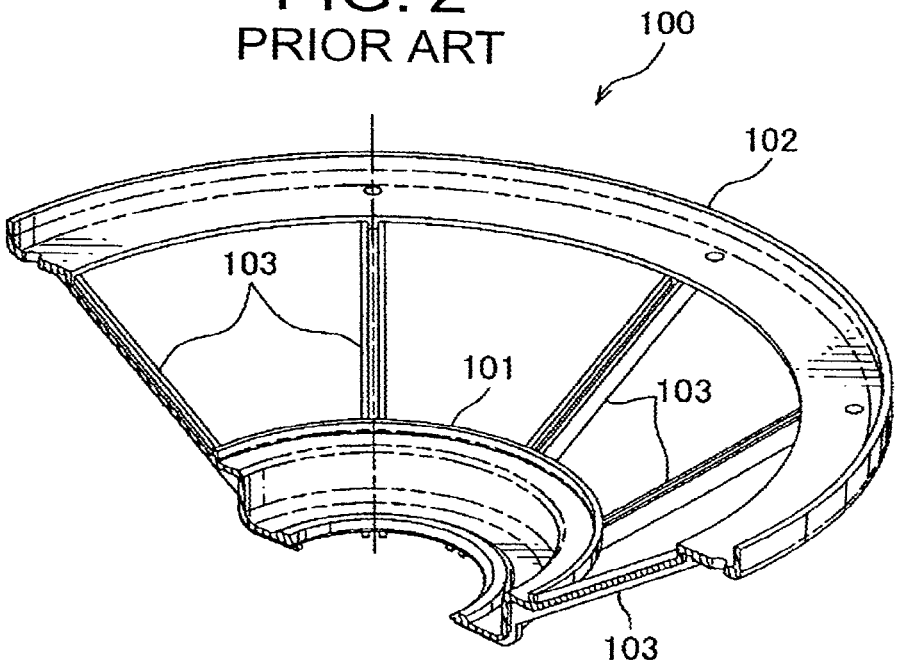
FIG. 2 PRIOR ART
FIG. 2 is a perspective view showing a partial cross-section of the speaker frame shown in FIG. 1.

1 speaker
2 magnetic circuit portion
4 speaker frame
14 damper
15 diaphragm (vibrating body)
18 magnet support portion
19 vibration support portion
20 connection beam
20*a* one connection beam
20*b* other connection beam
21 bottom portion
21 a back face
23 damper mounting portion
24*a* surface (mounting face)
24*b* back face
26 vibrating body mounting portion
29 first linear portion
30 second linear portion
31 groove
32, 33 H-shaped portion
34 tubular portion
35 flange portion
Θ1, Θ2 inclination angle
P central axis

DESCRIPTION OF EMBODIMENTS

One embodiment of the present invention will be explained below. For a speaker frame according to one embodiment of the present invention, in a cross section passing through a central axis of a speaker, an inclination angle of one connection beam of a plurality of connection beams to the central axis and an inclination angle of other connection beam to the central axis are different. In such manner, rigidity of the speaker frame can be ensured while reducing the weight thereof by positioning the plurality of connection beams at an interval. Therefore, the frame can be prevented from being distorted, e.g. curved, reducing in an acoustic characteristic, and resonating with a door panel of a motor vehicle when the frame is mounted at the door panel. Furthermore, a resonance at the frame produced by the vibration of a magnetic circuit can be prevented when the speaker is driven.

The one connection beam may be formed linearly, and the other connection beam may be formed so as to include a first linear portion and a second linear portion bending from the first linear portion. In this case, inclination angles of these connection beams to the central axis of the speaker will securely be different from each other and rigidity of the speaker frame can be reliably ensured.

The second linear portion of the other connection beam may be arranged substantially parallel to the central axis. In this case, an inclination angle of the first linear portion of the other connection beam to the central axis will securely be different from the inclination angle of the one connection beam to the central axis.

The connection beam may include a groove. Furthermore, the groove may be provided at the first linear portion of the other connection beam. In this case, rigidity of the connection beam can be reliably ensured while reducing the weight of the connection beam, i.e. the speaker frame.

The connection beam may include a H-shaped portion having a H-shaped cross-section. Furthermore, the H-shaped portion can be provided at the first linear portion of the other connection beam. In this case, rigidity of the connection beam can be reliably ensured while reducing the weight of the connection beam, i.e. the speaker frame.

A magnet support portion may include a damper mounting portion at which a damper is mounted. In this case, rigidity of not only the connection beam but also of the magnet support portion can be reliably ensured.

At least one of the connection beams may connect to a back face of the damper mounting portion in a view of a mounting face of the magnet support portion. In this case, since the connection beam projects from the magnet support portion, rigidity of the magnet support portion can be reliably ensured.

At least one of the connection beams connects to a back face of a bottom portion of the magnet support portion. In this case, since the connection beam projects from the bottom portion of the magnet support portion, rigidity of the magnet support portion can be reliably ensured.

A vibration support portion may include a flange portion projecting from the vibration support portion in an outer circumferential direction. In this case, rigidity of the vibration support portion can be reliably ensured.

A plurality of the one connection beams and a plurality of the other connection beams may be provided. In this case, rigidity of the speaker frame can be securely improved. Furthermore, an external force acting on the frame can be dispersed to (absorbed by) the plurality of connection beams. Furthermore, by providing the plurality of connection beams, the speaker can include several transmission paths of the vibration transmitting on the frame, thus the vibration can be canceled out on the frame.

The vibration support portion may include a tubular portion connecting to an outer edge of a vibrating body mounting portion. In this case, rigidity of the vibration support portion can be improved, and thus rigidity of the speaker frame can be securely improved.

Both of the one connection beam and the other connection beam may extend from the vibrating body mounting portion further to the tubular portion. In this case, the connection beam can be formed to project from the vibrating body mounting portion, and thus rigidity of the vibration support portion can be further improved.

The one connection beam may connect to the vibrating body mounting portion, and the other connection beam may connect to the tubular portion. In this case, positions at which these connection beams connect to the vibration support portion are different from each other, thus rigidity of the speaker frame can be improved.

The other connection beam may extend from the tubular portion further to the vibrating body mounting portion. In this case, the other connection beam can be formed to project from the tubular portion, thus rigidity of the vibration support portion can be further improved.

A portion at which the other connection beam connecting to the tubular portion may be positioned near the magnet support portion compared to a portion at which the one connection beam connecting to the vibrating body mounting portion. In this case, the positions at which these connection beams connecting to the vibration support portion are displaced along the central axis, thus rigidity of the speaker frame can be improved.

The present invention may be a speaker including the above-described speaker frame. In this case, rigidity of the speaker frame can be improved, distortion of the speaker frame can be prevented and reduction in the acoustic characteristic can be prevented.

Exemplary Embodiment 1

The first exemplary embodiment of the present invention will be explained with reference to FIG. 3 through FIG. 8. A speaker 1 according to the first exemplary embodiment of the present invention shown in FIG. 1 is mounted at a door panel and such of a motor vehicle and provides voice information to a passenger of the motor vehicle.

Figure 3:
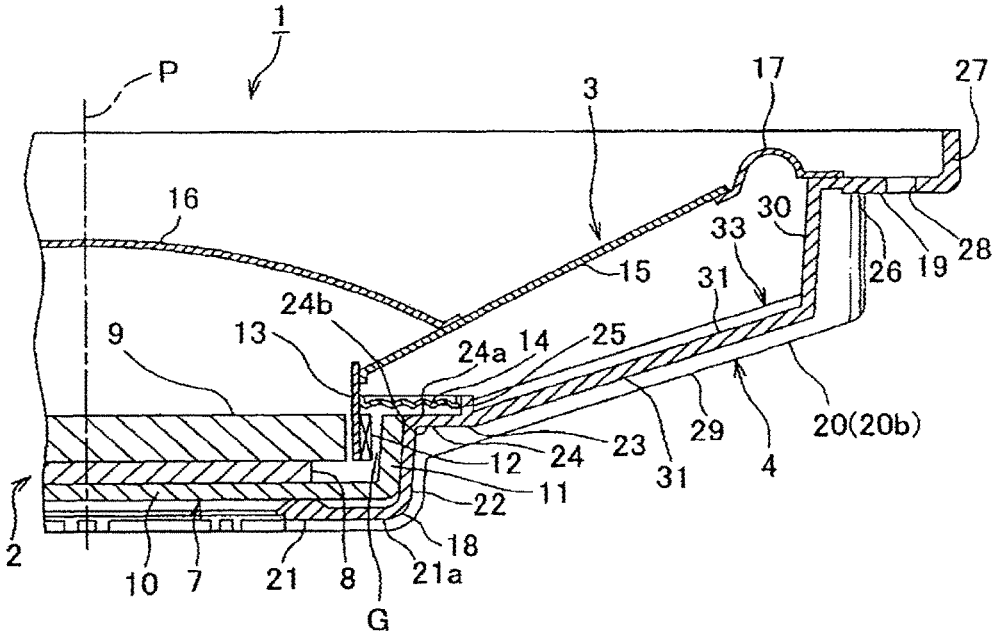
FIG. 3 is a perspective view showing a partial cross-section of a speaker according to a first exemplary embodiment of the present invention.

The speaker 1, as shown in FIG. 3, includes a magnetic circuit portion 2, a vibrating portion 3, a wiring portion not shown and a speaker frame (hereinafter called the frame) 4.

The magnetic circuit portion 2 is fixed to a later-described bottom portion 21 of magnet support portion 18 of the frame 4 and fixed to the frame 4. As shown in FIG. 3, the magnetic circuit portion 2 includes a yoke 7 constituted of for example a magnetic body (so-called paramagnetic or ferromagnetic body), a magnet 8 and a plate 9 constituted of for example a magnetic body (so-called paramagnetic or ferromagnetic body).

The yoke 7 is an inner magnet-type magnetic circuit which integrally includes a circular-plate-like circular plate portion 10 and a cylinder-like tube portion 11 formed so as to extend from an outer edge of the circular plate portion 10. Although the inner magnet-type magnetic circuit is disclosed in this exemplary embodiment, the present invention may utilize an outer-magnet type magnetic circuit or a magnetic circuit combined with the inner magnet-type and the outer-magnet type magnetic circuit (a magnetic circuit with a magnet disposed inside and outside of a voice coil bobbin).

The magnet 8 is formed into a circular-plate-like shape and is received in the tube portion 11 of the yoke 7 while being disposed on the yoke 7. An outer diameter of the magnet 8 is smaller than both of an outer diameter of the circular plate portion 10 of the yoke 7 and an inner diameter of the tube portion 11. The above-described magnet 8 may be a permanent magnet or a material excited by DC electricity.

The plate 9 is formed into a circular-plate-like shape. An outer diameter of the plate 9 is smaller than both of the outer diameter of the circular plate portion 10 of the yoke 7 and the inner diameter of the tube portion 11. The plate 9 is received in the tube portion 11 of the yoke 7 while being disposed on the magnet 8. The yoke 7, the magnet 8 and the plate 9 are arranged substantially concentrically so centers thereof are substantially the same. Thus, an inner circumferential face of the tube portion 11 of the yoke 7 and an outer circumferential face of the plate 9 face each other with an interval (a magnetic gap G) therebetween.

Furthermore, the yoke 7, the magnet 8 and the plate 9 are fixed to the bottom portion 21 of the frame 4 with a bolt not shown penetrating through the bottom portion 21 or an adhesive or the like. In such manner, the magnetic circuit 2 is fixed to the frame 4 by the plate 9 being fixed to the bottom portion 21. Of course, the yoke 7, the magnet 8 and the plate 9 are arranged substantially concentrically with the frame 4.

With the structure described above, the magnetic circuit 2 includes the magnetic gap G having large magnetic flux density between the inner circumferential face of the tube portion 11 of the yoke 7 and the outer circumferential face of the plate 9.

The vibrating portion 3 is placed (supported) inside the frame 4. The vibrating portion 3 includes a voice coil 12, a voice coil bobbin 13, a diaphragm 15 as a vibrating body, an edge 17, a center cap 16 and a damper 14.

In this exemplary embodiment, a voice coil 12 is provided and formed with a coil wound around an outer circumference of the voice coil bobbin 13. Also, this voice coil 12 is, before driving the diaphragm 15, arranged within the above-described magnetic gap G of the magnetic circuit 2. Voice currents are supplied to the voice coil 12 via later-described lead wires not shown.

The voice coil bobbin 13 is formed into a cylinder-like shape. An inner diameter of the voice coil bobbin 13 is formed larger than an outer diameter of the plate 9. An outer diameter of the voice coil bobbin 13 is formed smaller than the inner diameter of the tube portion 11 of the yoke 7. The voice coil bobbin 13 is arranged substantially concentrically with the yoke 7, plate 9 and the voice coil 12. For the voice coil bobbin 13, one end portion thereof is inserted into the magnetic gap G, and the voice coil 12 is attached to an outer circumference of the one end portion. The voice coil bobbin 13 is supported by the diaphragm 15 and the damper 4 and such so as to be movable along a central axis of the yoke 7. The central axis of the yoke 7 is substantially the same as a central axis P of the speaker 1 (indicated by a dotted line shown in FIG. 3).

The diaphragm 15 is made of a resin. In order to reduce the weight of the speaker 1, metal material such as aluminum or other known materials including ceramics may be used as well. The diaphragm 15 is formed into a circular-ring-like shape having a conical (cone-like) appearance. The diaphragm 15, with an inner edge portion thereof attached to the other end portion of the voice coil bobbin 13, is slant as it gets from the voice coil bobbin 13 towards the outer circumferential direction, in a direction towards a later-described vibration support portion 19 of the frame 4. The diaphragm 15 is supported vibratably with respect to the frame 4 by the damper 14 via the voice coil bobbin 13. Also, the diaphragm 15 vibrates by the voice coil 12 and generates sound.

The edge 17 is formed into a circular-ring-like shape, and an inner edge thereof is attached to an outer edge portion of the diaphragm 15, while an outer edge of the edge 17 is attached to an inner edge portion of a later-described vibrating body mounting portion 26 of the vibration support portion 19. For the edge 17, the shape of a cross-section thereof is formed into a convex shape (an arc-like shape) towards the sound emitting side of the speaker 1. The edge 17 supports the diaphragm 15 vibratably with respect to the frame 4.

The center cap 16 is formed into a circular-plate-like shape, and a central portion thereof is formed so as to curve projectingly in a direction of the sound emitting of the diaphragm 15, i.e. a direction away from the magnetic circuit 2. The center cap 16 is arranged at a position substantially concentric with the diaphragm 15. An outer edge portion of the center cap 16 is fixed to the inner edge portion of the diaphragm 15. And the center cap is provided at a central portion of the diaphragm 15.

The damper 14 is made of a breathable member. In particular, the breathable member includes a nonwoven fabric made of fibers, or a sheet-like member obtained by adding (impregnating or coating) a resin to a nonwoven fabric, and known member can be utilized. Also, for example, the fiber forming the nonwoven fabric includes a polyamide-system resin such as a kepler or a polyester-system resin and such, and the resin includes a phenol-system resin and such. In addition, a method for adding a resin to the nonwoven fabric includes, for example, impregnating or coating a solution, then drying in a suitable manner. The solution has a resin to be added and an organic solvent to diffuse the resin. As the method for adding the resin, using a known method is possible. The damper 14 is entirely formed into a circular-ring-like (annular) shape. An inner edge of the damper is attached to an outer circumferential face of the other end portion of the voice coil bobbin 13, and an outer edge of the damper is attached to an inner circumferential face of a later-described damper mounting cylinder portion 25 of the magnet support portion 18. Of course, this damper 14 is arranged substantially concentrically with the magnetic circuit 2, the diaphragm 15 and the voice coil bobbin 13 and such.

For the above-described damper 14, the inner edge thereof is attached to the outer circumferential face of the voice coil bobbin 13, while the outer edge thereof is attached to the inner circumferential face of the damper mounting cylinder portion 25, damping the vibration of the diaphragm 15 (in a direction perpendicular to a direction of the vibration of the voice coil).

The above-described damper 14 of the vibrating body 3, the diaphragm 15 and the center cap 16 are, of course, arranged substantially concentrically with the frame 4 and the magnetic circuit 2. For the vibrating body 3, when currents corresponding to voice information (i.e. voice currents) are supplied to the voice coil 12, the diaphragm 15 to which the vibration of the voice coil 12 is transmitted vibrates along the above-described central axis, producing sound corresponding to the voice currents. That is, the diaphragm 15 vibrates due to a driving force (electromagnetic force) applied to the voice coil 12.

The wiring portion includes lead wires connected to the voice coil 12. The lead wires, i.e. the wiring portion, supply the voice currents to the voice coil 12 via a known amplifier and such.

Figure 4:
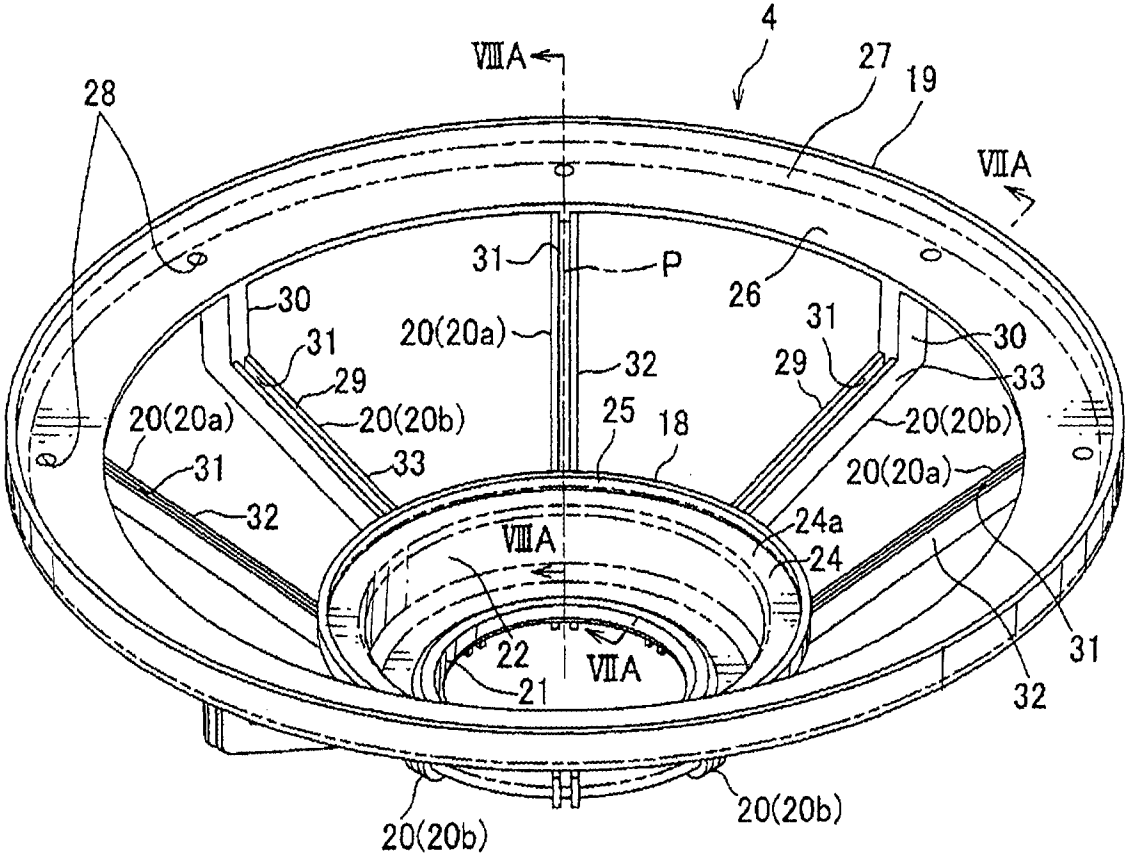
FIG. 4 is a perspective view of a frame of the speaker shown in FIG. 3.
Figure 5:
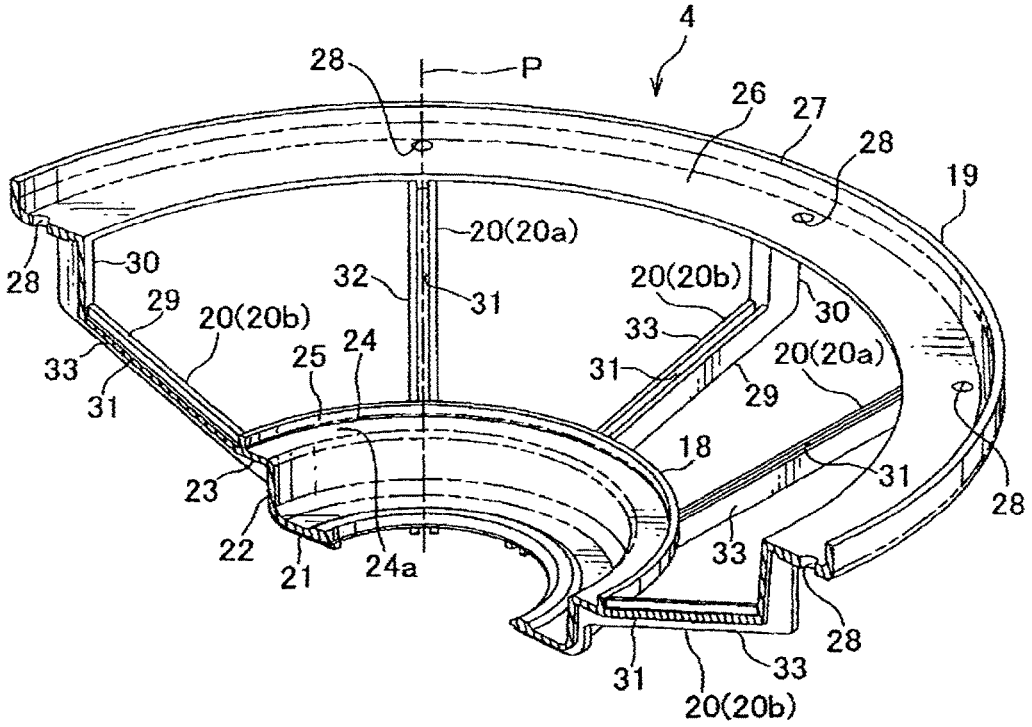
FIG. 5 is a perspective view showing a partial cross-section of the frame shown in FIG. 4.

As shown in FIG. 4 and FIG. 5, the frame 4 integrally includes, the circular-ring-like (annular) magnet support portion 18, the circular-ring-like vibration support portion 19 in which the magnet support portion 18 is positioned at an inner side thereof, and a plurality of connection beams 20 connected to the magnet support portion 18 and the vibration support portion 19.

The magnet support portion 18 includes the circular-ring-like bottom portion 21, a cylinder-like circle tube portion 22 provided to stand from an outer edge of the bottom portion 21, and the damper mounting portion 23. For the bottom portion 21, the circular portion 10 of the yoke 7 and such are disposed on a surface of the bottom portion 21 and the magnetic circuit portion 2 is attached. For this reason, the bottom portion 21 is positioned farther from the vibration support portion 19 compared to the damper mounting portion 23.

The damper mounting portion 23 includes: a circular-ring-like flange portion 24 extending from an edge portion of the circle tube portion 22 distant from the bottom portion 21 in an outer circumferential direction of the circle tube portion 22; and the damper mounting cylinder portion 25 provided to stand from an outer edge portion of the flange portion 24 in the same direction as a direction towards the circle tube portion 22 provided to stand from the bottom portion 21. On a surface 24*a* (corresponds to a mounting face in claims) of the flange 24 exposed to a direction of the sound emitting, the damper 14 is disposed with a space. An outer edge of the damper 14 is attached to the inner circumferential face of the damper mounting cylinder portion 25.

The vibration support portion 19 integrally includes, the circular-ring-like vibrating body mounting portion 26 and an outer tube portion 27 provided to stand from an outer edge of the vibrating body mounting portion 26 in the same direction as a direction towards the circle tube portion 22 provided to stand from the bottom portion 21. The outer edge portion of the edge 17 is attached to the inner edge portion of the vibrating body mounting portion 26. The diaphragm 15 is mounted at the vibrating body mounting portion 26 via the edge 17.

Furthermore, the vibrating body mounting portion 26 of the vibration support portion 19 is provided with through a hole 28 through which a bolt is passed for fixing the frame 4, i.e. the speaker 1, to a door panel and such of a motor vehicle.

Figure 6:
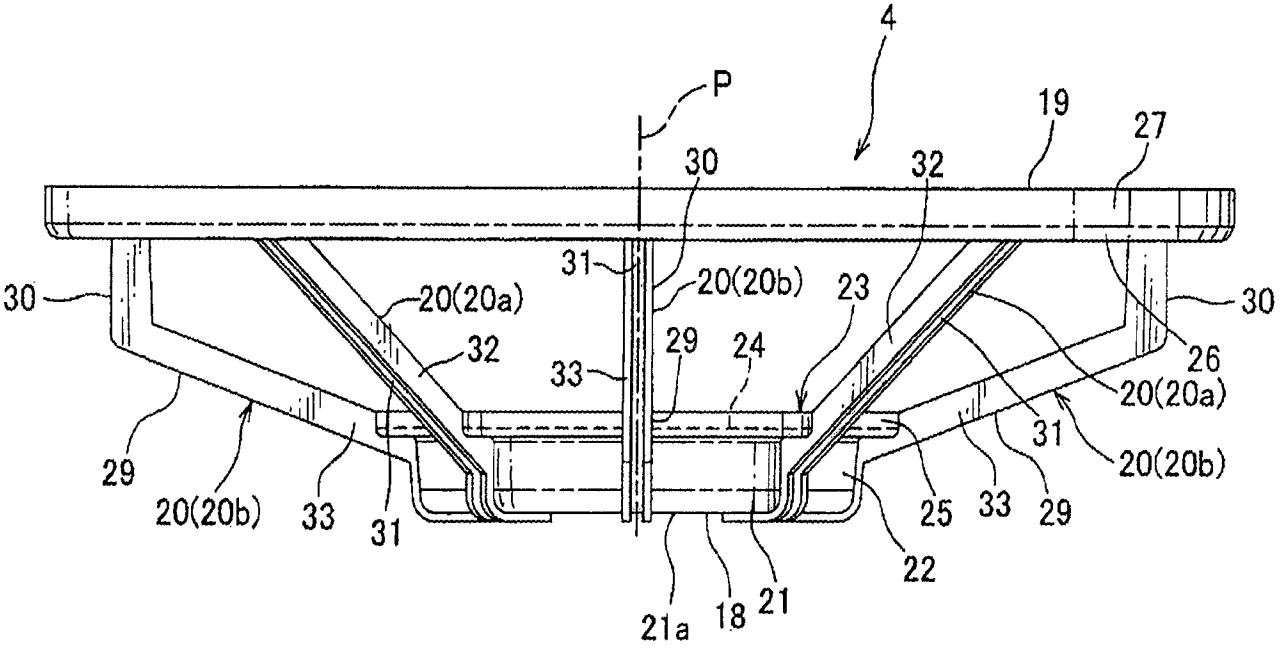
FIG. 6 is a side view of the frame shown in FIG. 4.

As shown in FIGS. 6, FIG. 7 A and FIG. SA, the plurality of connection beams 20 are formed into a rod-like shape. One ends of the connection beams 20 connect to an outer edge of the flange portion of magnet support portion 18, and other ends of the connection beams 20 connect to an inner edge of the vibration body mounting portion 26 of the vibration support portion 19. The plurality of the connection beams 20 are arranged at an interval in the circumferential direction of the frame 4, i.e. the speaker 1.

Figure 7A:
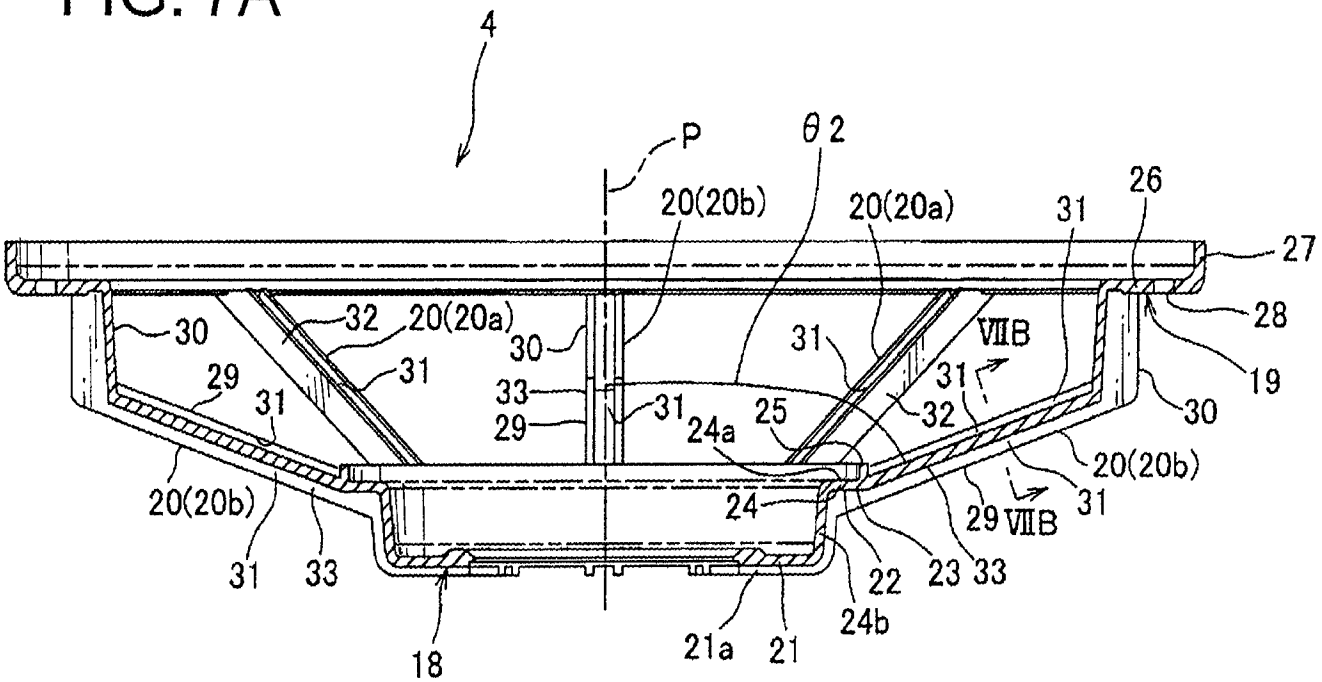
FIG. 7A is a cross-sectional view taken along a line VIIA-VIIA shown in FIG. 4.

Furthermore, as shown in FIG. 8A, one connection beam 20 (hereinafter indicated with a reference sign 20*a*) of the plurality of connection beams 20 extends linearly from the magnet support portion 18 towards the vibration support portion 19. Furthermore, as shown in FIG. 7A, other connection beam 20 (hereinafter indicated with a reference sign 20*b*) of the plurality of connection beams 20 includes a first linear portion 29 and a second linear portion 30. The first linear portion 29 includes one end extending linearly and connecting to the magnet support portion 18. The second linear portion 30 extends linearly and connects to the inner edge portion of the vibrating body mounting portion 26 of the vibration support portion 19 and bends from the other end of the first linear portion 29. For the first liner portion 29, an inclination angle Θ2 (shown in FIG. 7A) to the central axis Pin a cross-section passing through the above-described central axis P of the frame 4 is formed greater than an inclination angle Θ1 (shown in FIG. 8A) of the one connection beam 20*a* to the central axis P in a cross-section passing through the central axis P of the above-mentioned one connection beam 20*a*. Furthermore, the second linear portion 30 is arranged substantially parallel to the above-described central axis P. In such manner, the one connection beam 20*a* and the other connection beam 20*b* are formed such that, in the cross-section passing through the central axis P of the frame 4, the inclination angles Θ1, Θ2 to the central axis P are different from each other.

Furthermore, in the shown exemplary embodiment, the one connection beam 20*a* and the other connection beam 20*b* are arranged alternately in the circumferential direction of the frame 4. That is, in the shown exemplary embodiment, there are only the one connection beam 20*a* and other connection beam 20*b* provided, and the respective connection beams 20*a*, 20*b* are provided plurally.

Figure 7B:
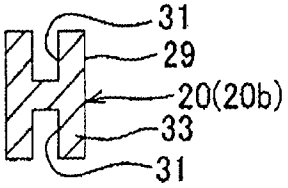
FIG. 7B is a cross-sectional view taken along a line VIIB-VIIB shown in FIG. 7A.

Furthermore, as shown in FIG. 7B and FIG. 8B, the connection beams 20*a*, 20*b* respectively include grooves 31 intersecting with the central axis P and concave from both surfaces. The grooves 31 extend linearly along the connection beams 20*a*, 20*b*. For the one connection beam 20*a*, the groove 31 is formed along the entire length of the one connection beam 20*a*. For the other beam 20*b*, the groove 31 is formed along the entire length of the first linear portion 29 whereas no grooves 31 are formed at the second linear portion 30. By including the grooves 31, the above-described one connection beam 20*a* includes a H-shaped portion 32 having a H-shaped cross-section along the entire length of the one connection beam 20*a*, as shown in FIG. 8B. The other connection beam 20*b* includes a H-shaped portion 33 having a H-shaped cross-section along the entire length of the first linear portion 29 (i.e., H-shape portion 33 is provided at the first linear portion 29), as shown in FIG. 7B.

Furthermore, as shown in FIG. 6, FIG. 7A and FIG. 8A, the connection beams 20*a*, 20*b* connect from the outer edge of the flange portion 24 of the magnet support portion 18 to a back face 24*b* of the damper mounting portion 23 in a view of the surface 24*a* of the flange portion 24 at which the damper is mounted and connect to a back face 21*a* of the bottom portion 21 in a view of the damper 14 via an outer circumferential face of the circle tube portion 22.

The frame 4 having the above-described structure is formed with a known material. There is a metal material such as iron or aluminum and a resin such as a polycarbonate resin, an ABS resin or an acrylic resin as the known material. Particularly, for a purpose of reducing the weight of the speaker 1, the frame 4 is preferably formed with a resin.

For the speaker 1 having the above-described structure, the voice currents are supplied to the voice coil 12 via the lead wires and such, and in response to the voice currents the voice coil 12 positioned in the magnetic gap G vibrates along the central axis P. Then, the voice coil bobbin 13 vibrates along the central axis P with the damper 14 and the diaphragm 15 and such. The voice coil 12 is wound around the outer circumference of the voice coil bobbin 13. That is, the diaphragm 15 to which the vibration of the voice coil 12 is transmitted vibrates and thereby generates sound corresponding to the voice currents. At this time, the damper 14 reduces the vibration of the diaphragm 15 (in the direction perpendicular to the direction of the vibration of the voice coil). Furthermore, the frame 4 includes the connection beams 20*a*, 20*b* having the inclination angles Θ 1, Θ 2 to the central axis P different from each other, thus rigidity of the frame 4 is improved and production of distortion such as curvature in the frame 4 can be prevented.

According to this exemplary embodiment, in the cross section passing through the central axis P of the speaker 1, the inclination angle Θ1 of the one connection beam 20*a* to the central axis P and the inclination angle Θ2 of other connection beam 20*b* to the central axis P are different from each other. Consequently, rigidity of the frame 4 can be ensured while reducing the weight thereof and positioning the plurality of connection beams 20*a*, 20*b* at intervals. Therefore, for example, production of distortion such as curvature in the frame 4 can be prevented, a resonance with a door panel of a motor vehicle when mounted at the door panel can be prevented, and deterioration in the acoustic characteristic can be prevented. Furthermore, a resonance in the frame 4 due to the vibration of a magnetic circuit 2 produced when the speaker 1 is driven can be prevented.

Furthermore, the one connection beam 20*a* is formed into a linear shape and the other connection beam 20*b* is formed so as to include the first linear portion 29 and the second linear portion 30 bending from the first linear portion 29. Consequently, the inclination angles Θ1, Θ2 of these connection beams 20*a*, 20*b* to the central axis P will securely be different, thereby reliably ensuring rigidity of the frame 4.

Since the second linear portion 30 of the other connection beam 20*b* is arranged substantially parallel to the central axis P, the inclination angles Θ1, Θ2 of the one connection beam 20*a* and of the first linear portion 29 of the other connection beam 20*b* to the central axis P will securely be different.

The connection beams 20*a*, 20*b* include the grooves 31. Furthermore, the grooves 31 are provided at the first linear portion 29 of the other connection beam 20*b*. Consequently, rigidity of the connection beams 20*a*, 20*b* can be reliably ensured while further reducing the weight of the connection beams 20*a*, 20*b*, i.e. the frame 4.

The connection beams 20*a*, 20*b* includes the H-shaped portions 32, 33 having the H-shaped cross-section. Moreover, this H-shaped portion 33 is provided at the first linear portion 29 of the other connection beam 20*b*. Consequently, rigidity of the connection beams 20*a*, 20*b* can be reliably ensured while further reducing the weight of the connection beams 20*a*, 20*b*, i.e. the frame 4.

The magnet support portion 18 includes the damper mounting portion 23 at which the damper 14 is attached.

Consequently, rigidity of not only the connection beams 20*a*, 20*b* but also of the magnet support portion 18 can be reliably ensured.

The bottom portion 21 at which the magnetic circuit portion 2 of the magnet support portion 18 is attached is positioned farther from the vibration support portion 19 compared to the damper mounting portion 23. Consequently, the damper mounting portion 23 and the bottom portion 21 are arranged at different positions along the central axis P, and thus rigidity of the magnet support portion 18 can be ensured.

The connection beams 20*a*, 20*b* connect to the back face 24*b* in a view of the surface 24*a* of the damper mounting portion 23. Consequently, the connection beams 20*a*, 20*b* are arranged to project from the magnet support portion 18, thereby ensuring rigidity of the magnet support portion 18.

The connection beams 20*a*, 20*b* connect to the back face 21*a* of the bottom portion 21 of the magnet support portion 18. Consequently, the connection beams 20*a*, 20*b* are arranged to project also from the bottom portion 21 of the magnet support portion 18, thereby ensuring rigidity of the magnet support portion 18.

A plurality of the one connection beam 20*a* and the other connection beam 20*b* is provided. Consequently, rigidity of the frame 4 can be securely improved. Furthermore, by providing the plurality of connection beams 20*a*, 20*b*, several transmission paths for the vibration transmitting on the frame 4 can be provided, thus the vibration can be canceled out at the frame 1.

The above-described speaker 1 includes the above-described frame 4. Consequently, by improving rigidity of the frame 4, production of distortion such as curvature in the frame 4 can be prevented, production of distortion in the edge with the distortion of the frame 4 can be prevented, displacement of the voice coil in the magnetic gap with the distortion of the edge can be prevented, contact of the voice coil 12 with the plate 9, the magnet 8 and the yoke 11 and such constituting the magnetic circuit portion 2 caused by the displacement of the voice coil can be prevented, and generation of an unwanted noise due to the above-described contact and deterioration in the acoustic characteristic due to the generation of the unwanted noise can be prevented. Furthermore, a resonance in the frame 4 due to the vibration of a magnetic circuit portion 2 produced when the speaker 1 is driven can be prevented. Furthermore, by providing the plurality of connection beams 20*a*, 20*b* at the frame 4, there can be provided several transmission paths for the vibration transmitting on the frame, thus the vibration can be canceled out at the frame, in other words, production of a resonance can be prevented.

Figure 10:
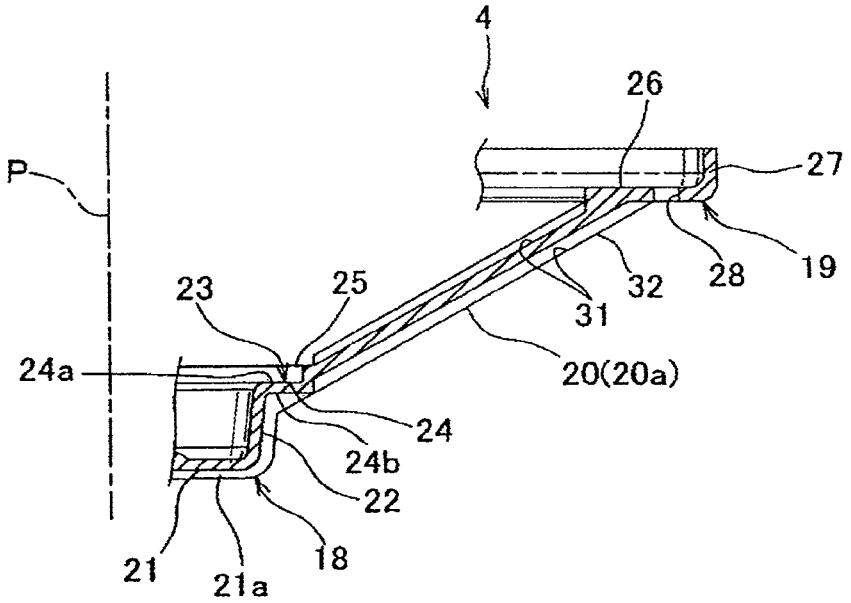
FIG. 10 is a cross-sectional view of another modified example of the frame shown in FIG. 8.
Figure 11:
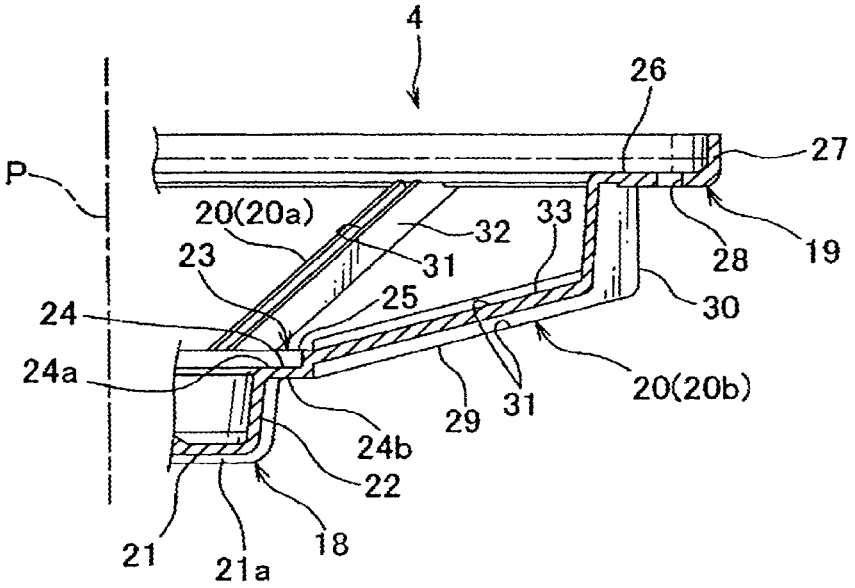
FIG. 11 is another cross-sectional view of the frame shown in FIG. 10.

In the above-described first exemplary embodiment, the one ends of the connection beams 20*a*, 20*b* connect to the outer edge of the flange portion 24 of the magnet support portion 18; however, in the present invention, the one ends of the connection beams 20*a*, 20*b* may connect to the outer edge of the bottom portion 21, as shown in FIG. 9 (FIG. 9 shows in case of the connection beam 20*b*), or the one ends of the connection beams 20*a*, 20*b* may connect to the outer circumferential face of the damper mounting cylinder portion 25 of the magnet support portion 18, as shown in FIG. 10 and FIG. 11. Furthermore, in regards to the connection beam 20*b* shown in FIG. 9, if necessary, especially only the first linear portion 29 of the connection beam 20*b* may be substantially parallel to the connection beam 20*a*. In this case, the second linear portion 30 may be different from an inclination angle Θ1 of the connection beam 20*a* to the central axis P, and may be configured to be either smaller than or greater than Θ1.

In addition, in FIG. 9 through FIG. 11, the components similar to those of the first exemplary embodiment are indicated by the same reference signs and a detailed explanation is eliminated. Also, when shown in FIG. 9 through FIG. 11, similar to the above-described first exemplary embodiment, it is possible, for example, to reliably ensure rigidity of the connection beam 20*a*, 20*b*, reliably ensure rigidity of the magnetic supporting portion 18, securely improve rigidity of the frame 4, prevent production of distortion such as curvature in the frame 4, prevent production of distortion in the edge 17 with the distortion of the frame 4 and the displacement of the voice coil 12 in the magnetic gap with the distortion of the edge 17, prevent contact of the voice coil 12 with the plate 9 and such constituting the magnetic circuit portion 2 caused by the displacement of the voice coil 12, prevent generation of an unwanted noise due to the above-described contact and prevent deterioration of the acoustic characteristic due to the generation of the unwanted noise. Furthermore, a resonance in the frame 4 due to the vibration of a magnetic circuit portion 2 produced when the speaker 1 is driven can be prevented. Furthermore, by providing the plurality of connection beams 20*a*, 20*b* at the frame 4, there can be provided several transmission paths for the vibration transmitting on the frame 4, thus the vibration can be canceled out at the frame 4, in other words, production of a resonance can be prevented.

Second Exemplary Embodiment

Next, a second exemplary embodiment of the present invention will be explained in reference with FIG. 12 through FIG. 15. For the second exemplary embodiment of the present invention shown in FIG. 12 through FIG. 15, the components similar to those of the first exemplary embodiment are indicated by the same reference signs and a detailed explanation is eliminated.

Figure 12:
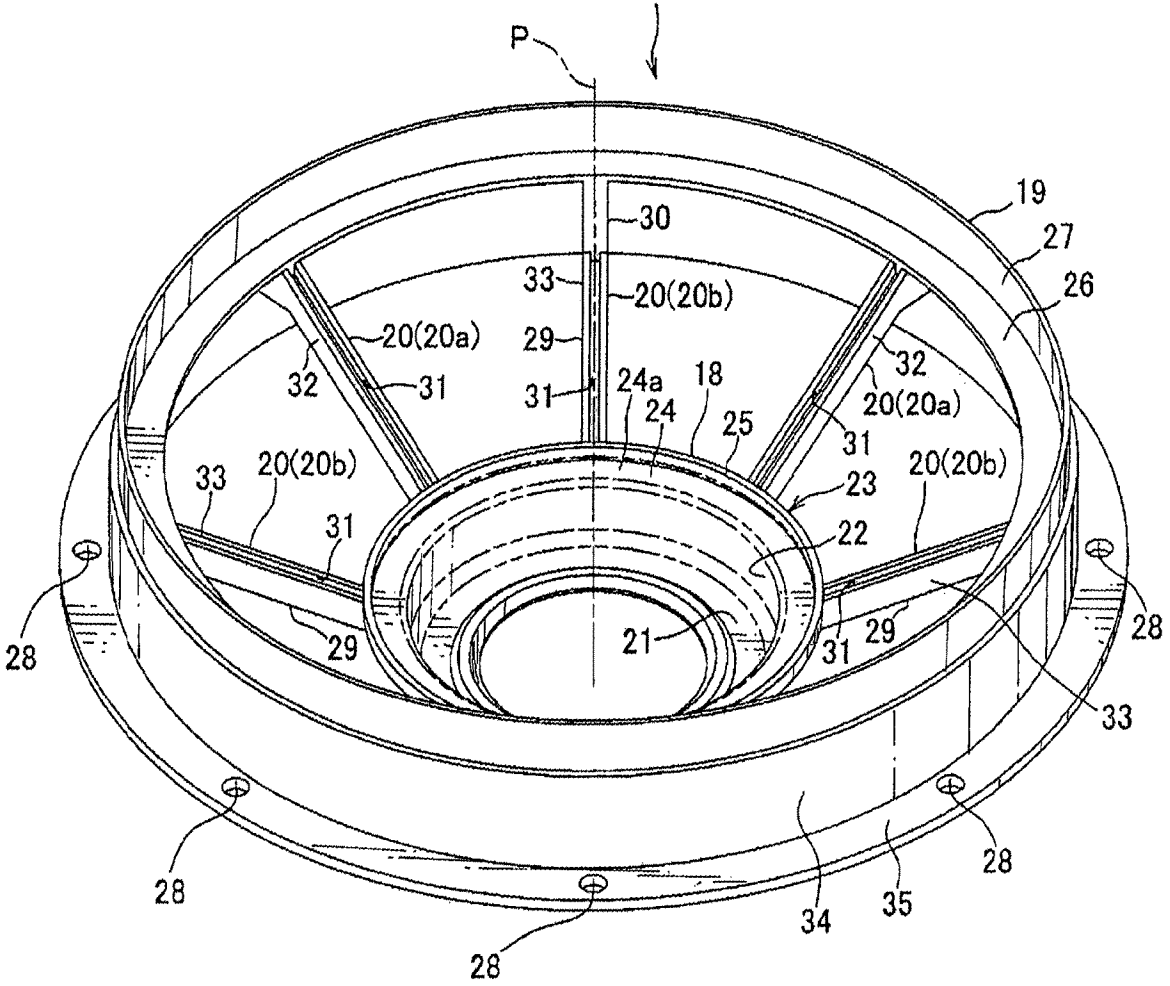
FIG. 12 is a perspective view of a frame of a speaker according to a second exemplary embodiment of the present invention.
Figure 13:
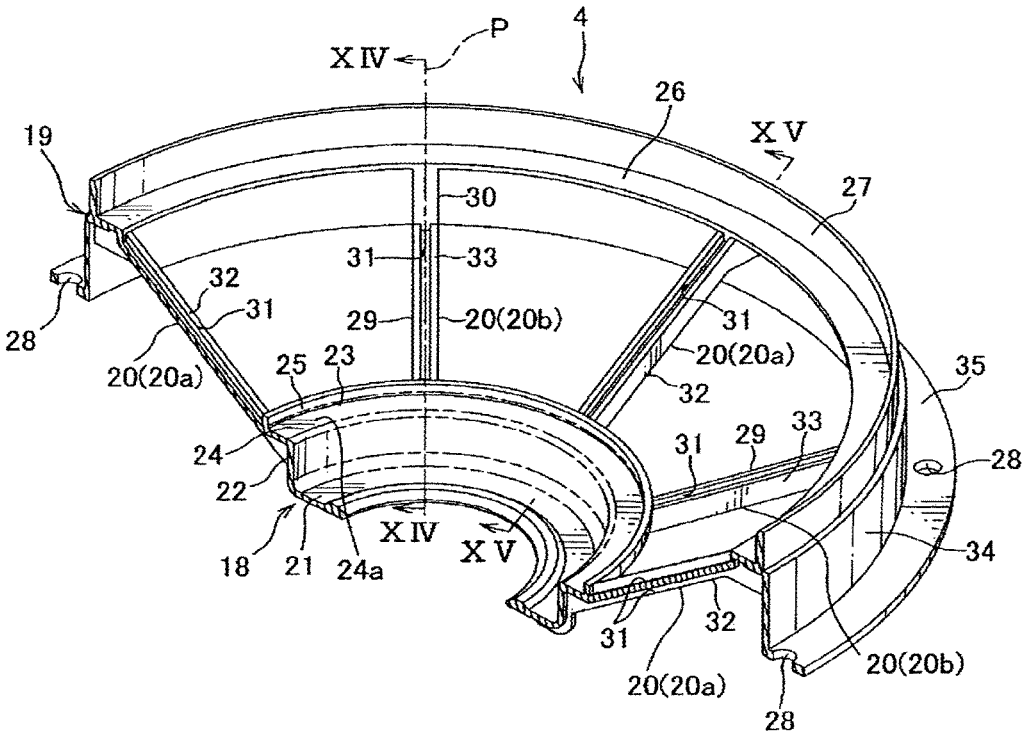
FIG. 13 is a perspective view showing a partial cross-section of the frame shown in FIG. 12.

In this exemplary embodiment, for the frame 4, as shown in FIGS. 12 and 13, the vibration support portion 19 includes a tubular portion 34 and a flange portion 35 in addition to the above-described vibrating body mounting portion 26 and the outer tube portion 27. The tubular portion 34 is formed into a cylinder-like shape and is provided to stand from the outer edge of the vibrating body mounting portion 26 in an opposite direction of the outer tube portion 27. The flange portion 35 is formed into a circular-ring-like shape. And an inner edge of the flange portion 35 connects to an edge of the tubular portion 34 distant from the vibrating body mounting portion 26. And the flange portion 35 projects from the tubular portion 34, i.e. the vibrating body mounting portion 26, in the outer circumferential direction. Furthermore, the flange portion 35 includes a through hole 28 to pass through a bolt for fixing the frame 4, i.e. the speaker 1, to a door panel.

Figure 14:
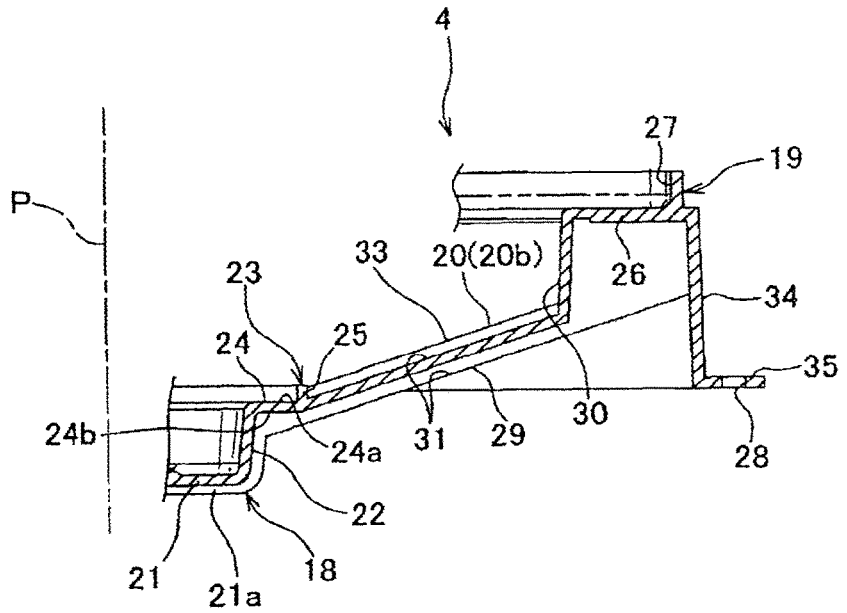
FIG. 14 is a cross-sectional view taken along a line XIV-XIV shown in FIG. 13.
Figure 15:
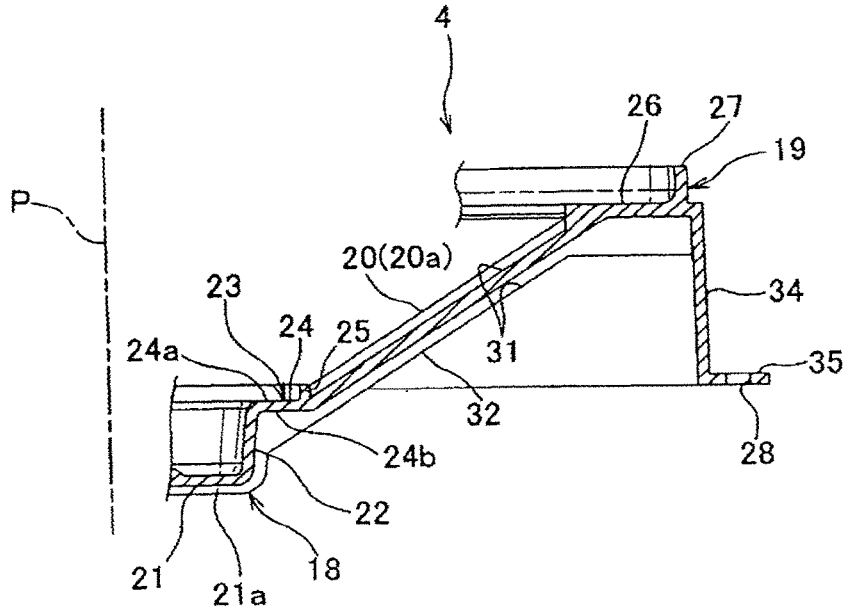
FIG. 15 is a cross-sectional view taken along a line XV-XV shown in FIG. 13.

Furthermore in this exemplary embodiment, the connection beams 20*a*, 20*b*, as shown in FIG. 14 and FIG. 15, extend from the inner edge of the vibrating body mounting portion 26 towards an inner circumferential face of the tubular portion 34 and, of course, connect to the inner circumferential face of the tubular portion 34.

According to this exemplary embodiment, the vibration support portion includes the tubular portion 34 connecting to the outer edge of the vibrating body mounting portion 26. Consequently, as compared with the above-described first exemplary embodiment, rigidity of the vibration support portion 19 can be further improved, thus rigidity of the frame 4 can be further improved. Furthermore, a resonance in the frame 4 due to the vibration of a magnetic circuit portion 2 produced when the speaker 1 is driven can be prevented.

Furthermore, both of the connection beams 20*a*, 20*b* extend from the vibrating body mounting portion 26 further to the tubular portion 34. Consequently, the connection beams 20*a*, 20*b* can be formed projectingly from the vibrating body mounting portion 26 and rigidity of the vibration support portion 19 can be further improved.

Moreover, the vibration support portion 19 includes the flange portion 35 projecting from the tubular portion 34, that is, from the vibration support portion 19, in the outer circumferential direction. Consequently, rigidity of the vibration support portion 19 can be reliably ensured.

Figure 16:
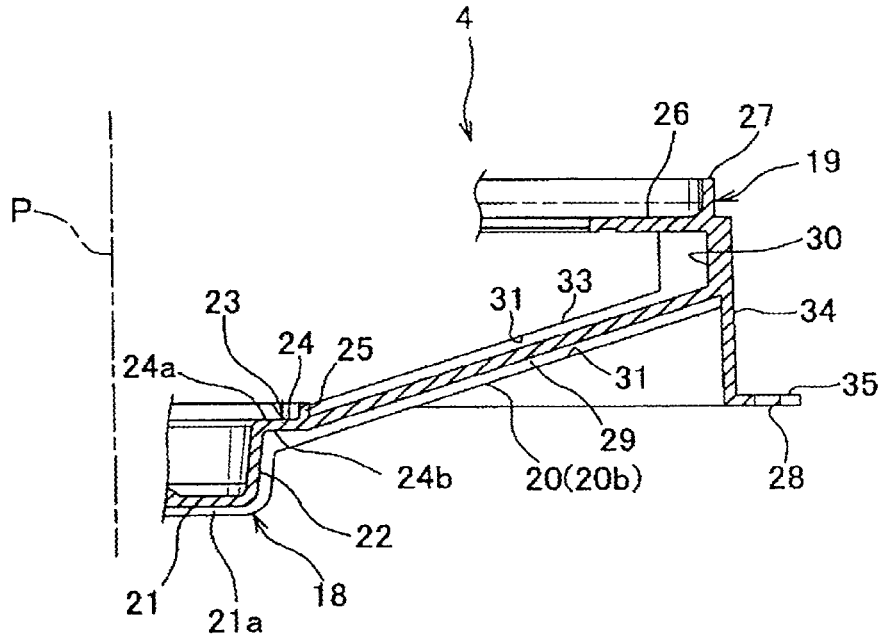
FIG. 16 is a cross-sectional view of a modified example of the frame shown in FIG. 14.

Furthermore, in this exemplary embodiment, as shown in FIG. 16, the first linear portion 29 of the other connection beam 20*b* may connect directly to the tubular portion 34, and a portion of the other connection beam 20*b* connecting to the tubular portion 34 may be positioned nearer to the magnet support portion 18 (downwardly) compared to a portion of the one connection beam 20*a* connecting to the vibrating body mounting portion 26. Furthermore, in FIG. 16, the second linear portion 30 of the other connection beam 20*b* may be integrally formed so as to project from the inner circumferential face of the tubular portion 34, extend to the vibrating body mounting portion 26 and, of course, connect to the vibrating body mounting portion 26.

In this case, the one connection beam 20*a* connects to the vibrating body mounting portion while the other connection beam 20*b* connects to the tubular portion 34. Thus, positions of the connection beams 20*a*, 20*b* connecting to the vibration support portion 19 are different from each other. Consequently, rigidity of the frame 4 can be improved.

The other connection beam 20*b* extends from the tubular portion 34 further to the vibrating body mounting portion 26. Consequently, the connection beam 20*b* can be formed to project from the tubular portion 34 and rigidity of the vibration support portion 19 can be further improved.

The portion of the other connection beam 20*b* connecting to the tubular portion 34 is positioned nearer to the magnet support portion 18 (downwardly) compared to the portion of the one connection beam 20*a* connecting to the vibrating body mounting portion 26. Consequently, the portions of the connection beams 20*a*, 20*b* connecting to the vibration support portion 19 are displaced along the central axis P, thus rigidity of the frame 4 can be improved.

According to the first and the second exemplary embodiments described above, the below-described speaker frame 4 is provided.

(Appendix) A speaker frame 4 including: a vibration support portion 19 supporting a diaphragm 15 of a speaker 1; a magnet support portion 18 arranged inside of the vibration support portion 19 and supporting a magnetic circuit portion 2 of the speaker 1; and a plurality of connection beams 20 connecting the vibration support portion 19 and the magnet support portion 18, in which, in a cross section passing through a central axis P of the speaker 1, an inclination angle Θ1 of one connection beam 20*a* to the central axis P and an inclination angle Θ2 of other connection beam 20 to the central axis P are different from each other.

According to the appendix, in the cross section passing through the central axis P of the speaker 1, the inclination angle Θ1 of the one connection beam 20*a* of the plurality of the connection beams to the central axis P is different from the inclination angle Θ2 of the other connection beam 20*b* to the central axis P. Consequently, rigidity of the frame 4 can be ensured while reducing the weight thereof and positioning the plurality of connection beams 20*a*, 20*b* at intervals. Therefore, production of distortion such as curvature in the frame 4 can be prevented, a resonance with a door panel of a motor vehicle when mounted at the door panel can be prevented, and deterioration of the acoustic characteristic can be prevented.

Figure 17:
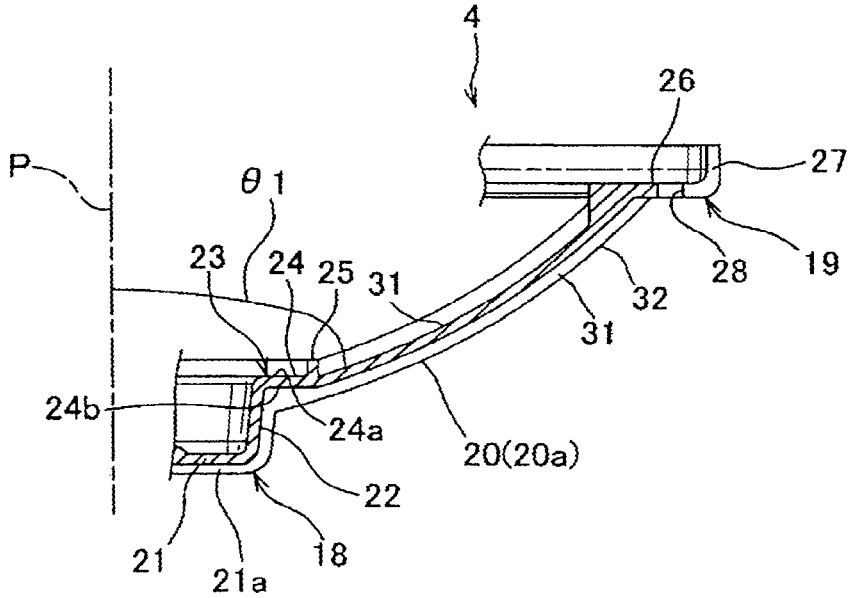
FIG. 17 is a cross-sectional view of another modified example of the frame shown in FIG. 8.
Figure 18:
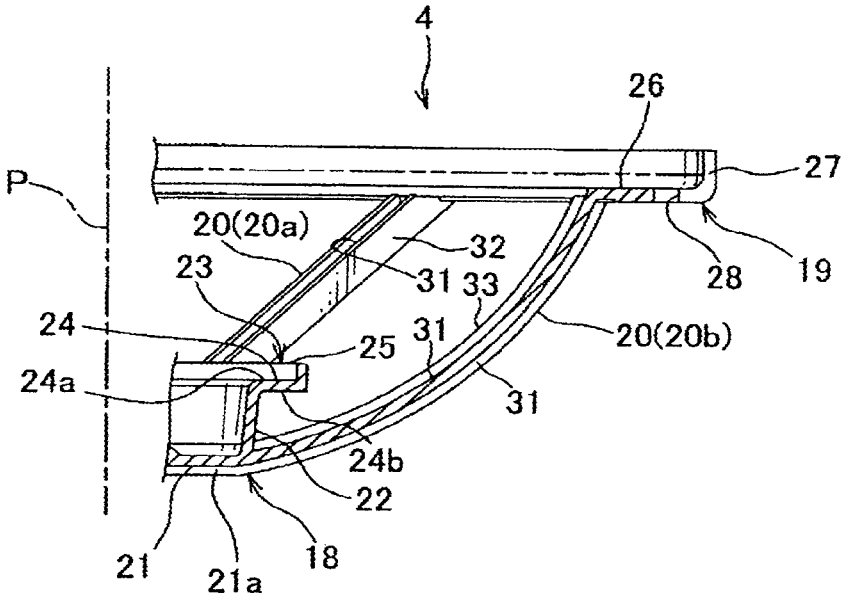
FIG. 18 is a cross-sectional view of another modified example of the frame shown in FIG. 9.

It is intended that the above-described exemplary embodiments are only representative embodiments, and it should be understood that the present invention is not limited thereto. That is, various changes can be made and practiced without departing the scope of the present invention. For example, the frame 4 may include the connection beams 20*a*, 20*b* having a cross section formed in a curved shape, as shown in FIG. 17 and FIG. 18. Also, for the modified example of the frame 4 shown in FIG. 17 and FIG. 18, the components similar to those shown in the above-described first and second exemplary embodiments are indicated by the same reference signs, thus a detailed explanation is eliminated. Although the frame 4 shown in FIG. 17 and FIG. 18 is a modified example of the frame 4 shown in the FIG. 7 and FIG. 8 of the first exemplary embodiment, it is not limited to this, and it may be a modified example for the second exemplary embodiment, without any limitation. Furthermore, if necessary, the connection beams 20*a*, 20*b* may have a substantially same shape.

Moreover, in the above-described exemplary embodiments, both of the connection beams 20*a*, 20*b* connect to the back face 24*b* of the damper mounting portion 23 and connect to the back face 21*a* of the bottom portion 21. However, in the present invention, at least one of the connection beams 20*a*, 20*b* may connect to the back face 24*b* of the damper mounting portion 23 and connect to the back face 21*a* of the bottom portion 21.

The invention claimed is:

1. A speaker frame, comprising:

a plurality of connection beams arranged radially about a central axis oriented in the sound-emitting direction, so as to connect a magnet support portion of a speaker to a vibration support portion of the speaker, the plurality of connection beams comprising, a first connection beam extending linearly forming a first angle with the central axis, and a second connection beam, wherein the vibration support portion is substantially annular and is attached to a vibration body of the speaker, and the magnet support portion is attached to a magnetic circuit portion of the speaker, wherein a first groove is formed on the first connection beam, and a second groove is formed on a first beam portion of the second connection beam and not formed on a second beam portion of the second connection beam, the first beam portion extending linearly forming a second angle with the central axis different than the first angle and extending from the magnet support portion to a bend of the second connection beam, and the second beam portion extending linearly from the bend to the vibration support portion in a direction different than the first beam portion.

2. The speaker frame as claimed in claim 1, wherein the first groove and the second groove extend linearly parallel to the first connection beam and the first beam portion, respectively.

3. The speaker frame as claimed in claim 1,
wherein a first end of the first beam portion connects to the magnet support portion, and a first end of the second beam portion connects to the vibration support portion.

4. The speaker frame as claimed in claim 3,
wherein a second end of the first beam portion and a second end of the second beam portion connect to each other.

5. The speaker frame as claimed in claim 1,
wherein the first groove is one of concave and U-shaped, and the second groove is one of concave and U-shaped.

6. The speaker frame as claimed in claim 1, wherein the second beam portion is substantially parallel to the central axis.

7. The speaker frame as claimed in claim 1, wherein a length of the first connection beam is a different than a length of the second connection beam.

8. The speaker frame as claimed in claim 1, wherein the second angle is greater than the first angle.

9. The speaker frame as claimed in claim 1, wherein:
the first groove comprises a length extending along the first connection beam; and
the second groove comprises a length extending along the first beam portion of the second connection beam, the length of the second groove is shorter than the length of the first groove.

10. A speaker comprising: a vibrating body; a magnetic circuit portion; and a frame,
a plurality of connection beams arranged radially about a central axis oriented in the sound-emitting direction, so as to connect a magnet support portion of a speaker to a vibration support portion of the speaker,
the plurality of connection beams comprising,
a first connection beam extending linearly forming a first angle with the central axis, and
a second connection beam,
wherein the vibration support portion is substantially annular and is attached to the vibration body of the speaker, and
the magnet support portion is attached to the magnetic circuit portion of the speaker,
wherein a first groove is formed on the first connection beam, and
a second groove is formed on a first beam portion of the second connection beam and not formed on a second beam portion of the second connection beam, the first beam portion extending linearly forming a second angle with the central axis different than the first angle and extending from the magnet support portion to a bend of the second connection beam, and the second beam portion extending linearly from the bend to the vibration support portion in a direction different than the first beam portion.

11. The speaker as claimed in claim 10,
wherein the first groove and the second groove extend linearly parallel to the first connection beam and the first beam portion, respectively.

12. The speaker as claimed in claim 10,
wherein a first end of the first beam portion connects to the magnet support portion, and a first end of the second beam portion connects to the vibration support portion.

13. The speaker as claimed in claim 12,
wherein a second end of the first beam portion and a second end of the second beam portion connect to each other.

14. The speaker as claimed in claim 10,
wherein the first groove is one of concave and U-shaped, and the second groove is one of concave and U-shaped.

15. A vehicle having a speaker including: a vibrating body; a magnetic circuit portion; and a frame,
a plurality of connection beams arranged radially about a central axis oriented in the sound-emitting direction, so as to connect a magnet support portion of a speaker to a vibration support portion of the speaker,
the plurality of connection beams comprising,
a first connection beam extending linearly forming a first angle with the central axis, and
a second connection beam,
wherein the vibration support portion is substantially annular and is attached to the vibration body of the speaker, and
the magnet support portion is attached to the magnetic circuit portion of the speaker,
wherein a groove is formed on the first connection beam, and
wherein the second connection beam includes:
a first beam portion on which a groove is formed, the first beam portion extending linearly forming a second angle with the central axis different than the first angle and extending from the magnet support portion to a bend of the second connection beam; and
a second beam portion on which a groove is not formed, the second beam portion extending linearly from the bend to the vibration support portion in a direction different than the first beam portion.

16. The vehicle as claimed in claim 15,
wherein the first groove and the second groove extend linearly parallel to the first connection beam and the first beam portion, respectively.

17. The vehicle as claimed in claim 15,
wherein a first end of the first beam portion connects to the magnet support portion, and a first end of the second beam portion connects to the vibration support portion.

18. The vehicle as claimed in claim 17,
wherein a second end of the first beam portion and a second end of the second beam portion connect to each other.

19. The vehicle as claimed in claim 15,
wherein the first groove is one of concave and U-shaped, and the second groove is one of concave and U-shaped.

20. The vehicle as claimed in claim 15, wherein the vehicle is a motor vehicle.

21. The vehicle as claimed in claim 15, wherein the speaker is in a door panel of a motor vehicle.

* * * * *